US010864550B2

(12) United States Patent
Eggertsen

(10) Patent No.: US 10,864,550 B2
(45) Date of Patent: Dec. 15, 2020

(54) SUBSEA UMBILICAL

(71) Applicant: NEXANS, Paris (FR)

(72) Inventor: Carl Fredrik Eggertsen, Stromstad (SE)

(73) Assignee: NEXANS, Courbevoie (FR)

( * ) Notice: Subject to any disclaimer, the term of this patent is extended or adjusted under 35 U.S.C. 154(b) by 494 days.

(21) Appl. No.: 14/722,743

(22) Filed: May 27, 2015

(65) Prior Publication Data

US 2016/0129474 A1 May 12, 2016

(30) Foreign Application Priority Data

May 28, 2014 (NO) ..... 20140659

(51) Int. Cl.

| | |
|---|---|
| ***B05D 7/20*** | (2006.01) |
| ***H01B 7/04*** | (2006.01) |
| ***E21B 17/00*** | (2006.01) |
| ***E21B 17/01*** | (2006.01) |

(52) U.S. Cl.

CPC ..... *B05D 7/20* (2013.01); *E21B 17/003* (2013.01); *E21B 17/01* (2013.01); *H01B 7/045* (2013.01)

(58) Field of Classification Search

CPC .... H01B 13/16; H01B 13/0165; H01B 13/14; H01B 7/14; H01B 7/17; H01B 7/18; F16L 11/00; F16L 11/04; F16L 11/10; G02B 6/4427–4429; G02B 6/443

USPC ..... 428/36.9; 138/118, 118.1, 172; 174/47, 174/68.1, 110 R, 110 PM

See application file for complete search history.

(56) References Cited

U.S. PATENT DOCUMENTS

| | | | | |
|---|---|---|---|---|
| 9,518,685 | B2 * | 12/2016 | Mast | F16L 11/22 |
| 2003/0008158 | A1 | 1/2003 | Carrus et al. | |
| 2003/0190444 | A1 * | 10/2003 | Stoppelmann | B32B 27/20 428/36.91 |
| 2004/0262026 | A1 * | 12/2004 | Granheim | H05B 3/56 174/102 SC |
| 2006/0275571 | A1 * | 12/2006 | Mure | B29C 47/0004 428/36.9 |
| 2012/0168199 | A1 * | 7/2012 | McCullough | H01B 7/14 174/113 R |
| 2013/0065000 | A1 * | 3/2013 | Smillie | B32B 1/08 428/35.3 |

FOREIGN PATENT DOCUMENTS

| | | |
|---|---|---|
| EP | 1478211 | 11/2004 |
| JP | H05144327 | 6/1993 |
| WO | 2008071237 | 6/2008 |
| WO | 2011008568 | 1/2011 |

OTHER PUBLICATIONS

Norwegian Search Report dated Oct. 10, 2014.
International Search Report dated Aug. 24, 2015.

* cited by examiner

*Primary Examiner* — Matthew D Matzek
(74) *Attorney, Agent, or Firm* — Sofer & Haroun, LLP

(57) ABSTRACT

An umbilical for subsea applications has at least one longitudinal internal element and a sheath, the sheath is formed by extrusion. The internal element is suitable for communicating fluids, electrical power or signals, or for carrying loads. The sheath is made of a polymer composite having a high density filler, the polymer composite having a density in the range 3 to 11 g/cm3.

13 Claims, 1 Drawing Sheet

SUBSEA UMBILICAL

RELATED APPLICATIONS

This application claims the benefit of priority from Norwegian Patent Application No. 2014 0659 filed. on May 28, 2014, the entirety of which is incorporated herein by reference.

FIELD OF INVENTION

The present invention concerns subsea umbilicals having a required weight to diameter ratio.

BACKGROUND

Subsea umbilicals often require a specific weight to diameter ratio and/or a minimum submerged weight to achieve on-bottom stability. The specific weight to diameter ratio is often a customer requirement and depends on the intended application.

Presently, to fulfil higher weight to diameter (w/d) ratio requirements, excess steel armour is commonly applied to the umbilical. The amount of steel armour required to obtain the w/d ratio thus exceeds the amount required for sufficient mechanical strength.

The excess steel armour comprises either polyethylene (PE)-sheathed steel wires incorporated in the umbilical during the lay-up process, or steel armouring wound around the element bundle of the umbilical after lay-up (traditional armouring process).

The present methods for achieving a specific w/d ratio present a number of disadvantages. To achieve a compact cross section there is often not room for circular weight elements within the umbilical (i.e. excess PE-sheathed steel wires). Moreover, the alternative method using traditional outer armouring causes the umbilical to have a larger outer diameter. Thus, in many instances there is presently no solution for obtaining a subsea umbilical having a compact cross section, and which fulfils a required w/d ratio. An umbilical having a compact cross section is desired since it means that longer delivery lengths of umbilical can be achieved for a given reel/basket length capacity compared to an umbilical having a larger cross section. In addition to an increased cross section, the use of excess steel armouring increases the cost of the umbilical. Said increase is both due to increased material costs and a more complicated manufacturing process.

The present invention aims to provide a subsea umbilical having a required w/d ratio while alleviating at least some of the disadvantages of the prior art.

SUMMARY OF THE INVENTION

The present invention provides a subsea umbilical, wherein a specific weight to diameter (w/d) ratio, minimum submerged weight per length (kg/m), or specific gravity, is obtained by use of at least one sheath made of a polymer composite comprising a high density filler, hereinafter termed a "polymer composite". The invention is further defined by the appended claims, and in the following:

In one aspect, the present invention provides an umbilical for subsea applications having at least one longitudinal internal element and at least one sheath, the sheath is formed by extrusion, and said internal element is suitable for communicating fluids, electrical power or signals, or for carrying loads, and wherein the sheath is made of a polymer composite comprising a high density filler, the polymer composite having a density in the range of 3 to 11 g/cm$^3$.

In one embodiment of the umbilical according to the invention, the amount of high density filler is in the range of 20 to 90 w/w % based on the total weight of the polymer composite.

In one embodiment of the umbilical according to the invention, the high density filler is metal based, the metal preferably selected from the group of chromium, nickel, copper, copper oxide, steel, iron, iron oxide, barium sulfate, tungsten, molybdenum and mixture thereof, and having a density of more than 4 g/cm$^3$.

In one embodiment of the umbilical according to the invention, the polymer in the polymer composite comprises at least one polymer selected from the group of high density polyethylene (HDPE), polyethylene (PE), polypropylene (PP), polyurethane (PU), polyamide (PA), and PBT (polybutylene terephthalate).

In another aspect, the present invention provides for the use of a polymer composite, comprising a high density filler, in a sheath of an umbilical to achieve a minimum submerged weight to length (kg/m), the polymer composite preferably having a density in the range of 3 to 11 g/cm$^3$.

In one embodiment of the use according to the invention, the amount of high density filler is in the range of 20 to 90 w/w % based on the total weight of the polymer composite.

In one embodiment of the use according to the invention, the high density filler is metal based, the metal preferably selected from the group of chromium, nickel, copper, copper oxide, steel, iron, iron oxide, barium sulfate, tungsten molybdenum, and mixture thereof, and having a density of more than 4 g/cm$^3$.

In one embodiment of the use according to the invention, the polymer in the polymer composite comprises at least one of HDPE, PE, PP, PU, PA and PBT.

In one embodiment, the use according to the invention is for subsea applications, wherein the umbilical has at least one longitudinal internal element, the sheath is formed by extrusion, and said internal element is suitable for communicating fluids, electrical power or signals, or for carrying loads, wherein the density of the polymer composite is such that the umbilical achieves a minimum submerged weight to length (kg/m).

In yet another aspect, the present invention provides a method of manufacturing an umbilical having a minimum submerged weight to length (kg/m), comprising the step of:

- providing at least one longitudinal element suitable for communicating fluids, electrical power or signals, or for carrying loads;
- determining the density and thickness of a sheath required to obtain the minimum submerged weight to length (kg/m); and
- extruding a sheath around the longitudinal element, the sheath made of a polymer composite comprising a high density filler and having a density in the range of 3 to 11 g/cm$^3$ such that the minimum submerged weight to length (kg/m) is obtained.

In one embodiment of the method according to the invention, the amount of high density filler is in the range of 20 to 90 w/w % based on the total weight of the polymer composite.

In one embodiment of the method according to the invention, the high density filler is metal based, the metal preferably selected from the group of chromium, nickel, copper, copper oxide, steel, iron, iron oxide, barium sulfate, tungsten molybdenum, and mixture thereof, and having a density of more than 4 g/cm$^3$.

In one embodiment of the method according to the invention, the polymer in the polymer composite comprises at least one of HDPE, PE, PP, PU, PA and PBT.

In one embodiment of the umbilical according to the invention, at least one sheath is a surrounding sheath external to all the longitudinal elements of the umbilical. Thus, the at least one sheath is an outer sheathing or the outermost layer of the umbilical.

The term umbilical as used in the present application is intended to cover cables such as power cables and load bearing cables, in addition to the commonly used meaning wherein an umbilical may comprise multiple elements, such as power phases, load bearing elements, optical fibers, hydraulic fluid lines and similar.

The term longitudinal element as used in the present application is intended to cover elements present in an umbilical, such as power phases, load bearing elements, optical fibers, hydraulic fluid lines and similar.

In all aspects and embodiments of the invention, the polymer composite may have a density in the range of 3 to 11 g/cm$^3$, 4 to 11 g/cm$^3$, 5 to 11 g/cm$^3$ or 6 to 11 g/cm$^3$.

In all aspects and embodiments of the invention, the amount of high density filler may be in the range of 20 to 90, 30 to 90, 40 to 80, or 40 to 70 w/w % based on the total weight of the polymer composite.

In all aspects and embodiments of the invention, the density of the high density filler is more than 4, more than 5, more than 6, or preferably more than 7 g/cm$^3$.

In a preferred embodiment of the invention, the polymer(s) of the polymer composite may be selected from the group of thermoplastic elastomers (TPE).

In a specific embodiment, the polymer composite comprises PA (polyamide) and/or PU (polyurethane) as the polymer(s), and tungsten as the high density filler in an amount of 10-60 wt % based on the total weight of the polymer composite.

One of the reasons for using polymer composites comprising high density fillers is to contribute to the weight of the umbilical if this is needed to make it more seabed stable or to meet the requirements of submerged weight per length that some of the applicants customers may have. The specific gravity SG of an umbilical according to the invention is typically 1.5-3.0, i.e. the umbilical is 1.5-3.0 times heavier than the displaced water.

SHORT DESCRIPTION OF THE DRAWINGS

DETAILED DESCRIPTION OF THE INVENTION

Figure 1:
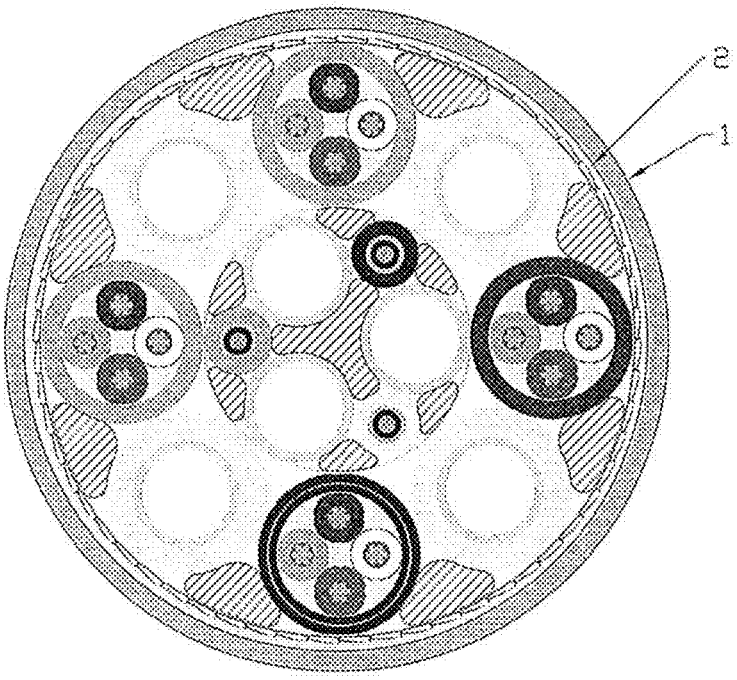
Fig. 1 (PRIOR ART)
FIG. 1 is a cross sectional view of a prior art umbilical.

A subsea umbilical comprising a prior art solution for obtaining a specific w/d ratio, minimum submerged weight per length (kg/m), or specific gravity, is shown in FIG. 1. The cross sectional view is of a 127 km long umbilical which the applicant delivered to Total for the Laggan Tormore field. This specific umbilical comprises multiple hydraulic lines comprising a steel tube and a surrounding high density polyethylene (HDPE) sheath, multiple electrical quads, fibre optic elements, PP filler, profiled PE filler, PP yarn and an outer HDPE sheath 1. To achieve a required specific gravity of 1.82 in seawater (corresponding to a submerged weight to diameter ratio of 81.8 kg/m), 4 layers of steel tape 2 were added to the umbilical. Both the specific gravity and the weight to diameter ratio are calculated based on the tubes and interstices of the umbilical being flooded with seawater. The minimum submerged weight per length (kg/m) is similarly calculated based on the tubes and interstices of the umbilical being flooded with seawater.

Figure 2:
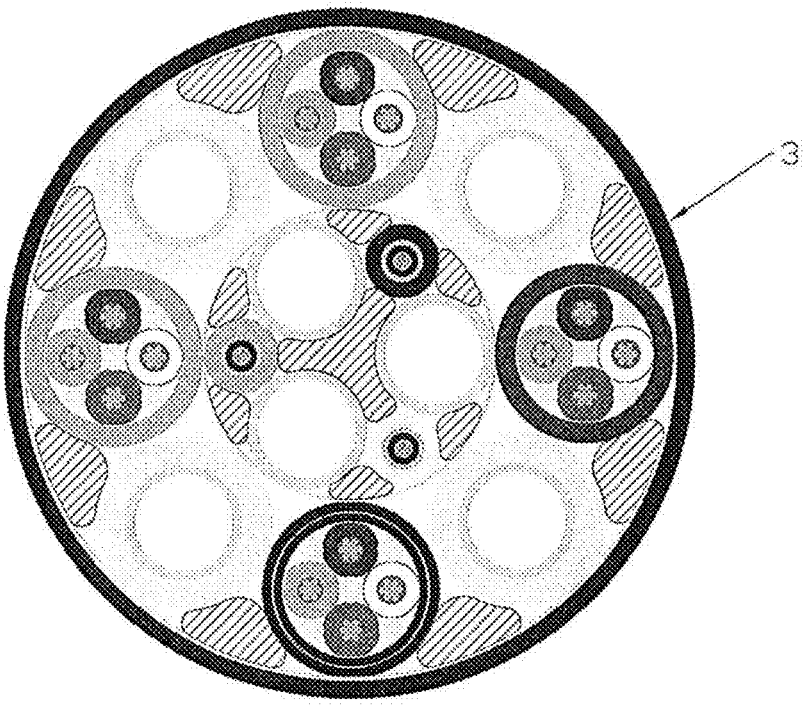
FIG. 2 is a cross sectional view of an umbilical according to the invention.

An umbilical according to the invention is shown in FIG. 2. The umbilical comprises the same internal elements as described in relation to FIG. 1. However, to obtain an umbilical having the same specific gravity as the one shown in FIG. 1, both the outer HDPE sheath 1 and the layers of steel tape 2 are replaced by an outer sheathing of a polymer composite 3 comprising a high density filler. The density of the polymer composite is such that the umbilical obtains the required specific gravity without use of any excess layers of steel tape. The thickness of the polymer composite layer 3 depends on its density and other properties such as abrasion resistance.

The polymer used in the polymer composite may comprise any suitable synthetic polymer base suitable for continuous extrusion, such as, but not limited to, HDPE (high density polyethylene), PE (polyethylene), PP (polypropylene) PU (polyurethane), PA (polyamide) and PBT (polybutylene terephthalate).

The polymer(s) of the polymer composite may preferably be selected from the group of thermoplastic elastomers (TPE).

Further, the polymer composite may be applied to the umbilical using a conventional extrusion process, for instance as used when applying a standard HDPE sheathing.

The filler used in the polymer composite is a high density filler having a density of more than 4 gi cm$^3$, more than 5 g/cm$^3$, or more than 6 g/cm$^3$. The high density filler is advantageously a metal-based filler such as chromium, nickel, copper, copper oxide, steel, iron, iron oxide, barium sulfate, tungsten and molybdenum, or similar. The high density filler may be in any form suitable for an extrudable polymer composite, e.g. particles and fibres.

A number of high density fillers and polymer composites comprising such fillers are commercially available, for instance those used in the Gravi-Tech™ compounds available from PolyOne Corporation. Further, various polymer composites suitable for extrusion, comprising high density fillers such as tungsten, are disclosed in U.S. Pat. No. 6,916,354 B2.

The polymer composite may advantageously have a density in the range of 3 to 11 g/cm$^3$, 4 to 11 g/cm$^3$, 5 to 11 g/cm$^3$ or 6 to 11 g/cm$^3$.

A preferred polymer composite comprises PA (polyamide) and/or PU (polyurethane) as the polymer(s), and tungsten as the high density filler in an amount of 10-60 wt % based on the total weight of the polymer composite.

Another suitable polymer composite can comprise PA as the polymer, and 10-30 wt % of chromium, and/or 10-30 wt % of nickel, and/or 1-5 wt % of molybdenum as the high density filler(s).

Polymer composites in the lower density range may comprise PA (polyamide) and/or PP (polypropylene) as the polymer(s), and barium sulfate as the high density filler in an amount of 60 wt % or more, based on the total weight of the polymer composite.

The present invention provides a number of advantages such as a more cost effective production since less outer steel armouring is required. This both saves raw material cost and reduced manufacturing time in the armouring machine. It also reduces the need for intermittent storage of semifinished product on turn tables. Further, for certain design requirements the outer steel armouring can be completely omitted.

In one embodiment, the umbilical of the invention further has armour elements such as armour wires layer (traditional armouring process) or outer steel armouring, specifically for additional mechanical protection and for tensile strength. Thus, the armour elements are used in combination with the high density composite sheath of the invention.

In another embodiment, the umbilical of the invention does not comprise any armour elements such as armour wires layer (traditional armouring process), outer steel armouring, excess steel armour comprising polyethylene (PE)-sheathed steel wires incorporated in the umbilical during the lay-up process, or steel armouring wound around the element bundle of the umbilical after lay-up (traditional armouring process) or other composite armour elements or several layers of metallic (e.g. steel) tape.

Another possible advantage is that the electrical properties of the sheath can be affected by the type of high density filler, in the form of a metal, which is added to the polymer composite. In a possible embodiment such a sheath can be made semi conductive for applications where this is needed, e.g. an inner sheath of power umbilicals.

A further advantage is that a polymer composite comprising for instance a metal based high density filler is harder than a HDPE sheath and will in many instances provide a better mechanical protection than the HDPE sheath used in current designs.

In a prior art umbilical the required diameter necessary to obtain a required minimum submerged weight per length (kg/m) will be larger than the one necessary with the proposed polymer metal composite sheath. This means that longer delivery lengths can be achieved for a given reel/basket length capacity since the outer diameter is smaller than a traditionally armoured umbilical.

The invention claimed is:

1. An umbilical power cable for subsea applications comprising:

at least one longitudinal internal element; and a sheath, the sheath is formed by extrusion, wherein said internal element is suitable for communicating fluids, electrical power or signals, or for carrying loads, said internal element being selected from optical fibers and electrical quads, and wherein the sheath is made of a polymer composite having a high density filler, the polymer composite having a density in the range 6 to 11 g/cm$^3$, and wherein said sheath is the outermost layer of the cable.

2. The umbilical power cable according to claim 1, wherein the amount of high density filler is in the range of 20 to 90 w/w % based on the total weight of the polymer composite.

3. The umbilical power cable according to claim 1, wherein the high density filler is metal based, the metal selected from the group consisting of chromium, nickel, copper, copper oxide, steel, iron, iron oxide, barium sulfate, tungsten, molybdenum and mixtures thereof, and having a density of more than 4 g/cm$^3$.

4. The umbilical power cable according to claim 1, wherein the polymer in the polymer composite has at least one of high density polyethylene (HDPE), polyethylene (PE), polypropylene (PP), polyurethane (PU), polyamide (PA) and polybutylene terephthalate (PBT).

5. A method of manufacturing an umbilical power cable according to claim 1, said umbilical having a minimum submerged weight to length (kg/m), said method comprising the step of:

providing at least one longitudinal element suitable for communicating fluids, electrical power or signals, or for carrying loads, said internal element being selected from optical fibers and electrical quads;

determining the density and thickness of a sheath required to obtain the minimum submerged weight to length (kg/m); and extruding a sheath around the longitudinal element, the sheath made of a polymer composite comprising a high density filler and having a density in the range of 6 to 11 g/cm$^3$ such that the minimum submerged weight to length (kg/m) is obtained.

6. A method according to claim 5, wherein the amount of high density filler is in the range of 20 to 90 w/w % based on the total weight of the polymer composite.

7. A method according to claim 5, wherein the high density filler is metal based, the metal is selected from the group consisting of chromium, nickel, copper, copper oxide, steel, iron, iron oxide, barium sulfate, tungsten, molybdenum and mixture thereof.

8. A method according to claim 5, wherein the polymer in the polymer composite has at least one of HDPE (high density polyethylene), PE (polyethylene), PP (polypropylene), PU (polyurethane), PA (polyamide) and PBT (polybutylene terephthalate).

9. The umbilical power cable according to claim 1, wherein the polymer composite comprises polyamide (PA) and/or polyurethane (PU) as the polymer(s), and tungsten as the high density filler in an amount of 10-60 wt % based on the total weight of the polymer composite.

10. The umbilical power cable according to claim 1, wherein the specific gravity SG of the umbilical is 1.5-3.0.

11. The umbilical power cable according to claim 1, wherein the polymer composite comprises polyamide (PA) as the polymer, and 10-30 wt % of chromium, and/or 10-30 wt % of nickel, and/or 1-5 wt % of molybdenum as the high density filler(s).

12. The umbilical power cable according to claim 1, wherein the polymer composite comprises polyamide (PA) and/or polypropylene (PP) as the polymer(s), and barium sulfate as the high density filler in an amount of 60 wt % or more, based on the total weight of the polymer composite.

13. The umbilical power cable according to claim 1, wherein the umbilical power cable has several longitudinal internal elements, and said longitudinal internal elements are multiple hydraulic lines comprising a steel tube, multiple electrical quads and multiple optical fibers.

* * * * *